US009969463B2

(12) United States Patent
Pivec

(10) Patent No.: US 9,969,463 B2
(45) Date of Patent: May 15, 2018

(54) VESSEL CONTROL SYSTEM WITH MOVABLE UNDERWATER WINGS

(71) Applicant: Quadrofoil, proizvodnja in storitve, d.o.o., Slovenska Bistrica (SI)

(72) Inventor: Simon Pivec, Ljubljana (SI)

(73) Assignee: QUADROFOIL, PROIZVODNJA IN STORITIVE, D.O.O., Slovenska Bistrica (SI)

( * ) Notice: Subject to any disclaimer, the term of this patent is extended or adjusted under 35 U.S.C. 154(b) by 47 days.

(21) Appl. No.: 14/912,773

(22) PCT Filed: Aug. 14, 2014

(86) PCT No.: PCT/SI2014/000047
§ 371 (c)(1),
(2) Date: Feb. 18, 2016

(87) PCT Pub. No.: WO2015/026301
PCT Pub. Date: Feb. 26, 2015

(65) Prior Publication Data

US 2016/0194054 A1 Jul. 7, 2016

(30) Foreign Application Priority Data

Aug. 21, 2013 (SI) ..... P201300223

(51) Int. Cl.
*B63B 1/28* (2006.01)
*B63B 1/30* (2006.01)

(52) U.S. Cl.
CPC ..... *B63B 1/283* (2013.01); *B63B 1/28* (2013.01); *B63B 1/30* (2013.01)

(58) Field of Classification Search
CPC ..... B63B 1/283; B63B 1/285; B63B 1/286; B63B 1/288; B63B 1/30; B63B 1/28; B63B 2001/281
See application file for complete search history.

(56) References Cited

U.S. PATENT DOCUMENTS

| | | | |
|---|---|---|---|
| 1,835,618 | A | 12/1931 | Waller |
| 2,856,878 | A | 10/1958 | Baker |
| 2,887,081 | A | 5/1959 | Bader |

(Continued)

FOREIGN PATENT DOCUMENTS

| | | | |
|---|---|---|---|
| CA | 2 209 047 | A1 | 1/1999 |
| SI | 22250 | A | 10/2007 |
| SI | 23103 | A | 1/2011 |

OTHER PUBLICATIONS

International Search Report issued in PCT/SI2014/000047; dated Feb. 4, 2015.

*Primary Examiner* — Ajay Vasudeva
(74) *Attorney, Agent, or Firm* — Studebaker & Brackett PC

(57) ABSTRACT

The control system of the vessel with moving underwater wings allows steering with the wings, while in turn the front pair of wings turns in the direction of the turn, the rear pair of wings turns in the opposite direction. The wing pairs settled in the direction of the turn radius. This reduces the turning radius and the roll of the vessel in comparison with conventional steering systems, increasing the maneuvrability of the vessel. The minimal roll of the vessel in the turns allows for an even and maximum distance between the surface and the entire hull of the vessel.

12 Claims, 3 Drawing Sheets

(56) References Cited

U.S. PATENT DOCUMENTS

Figure 1:
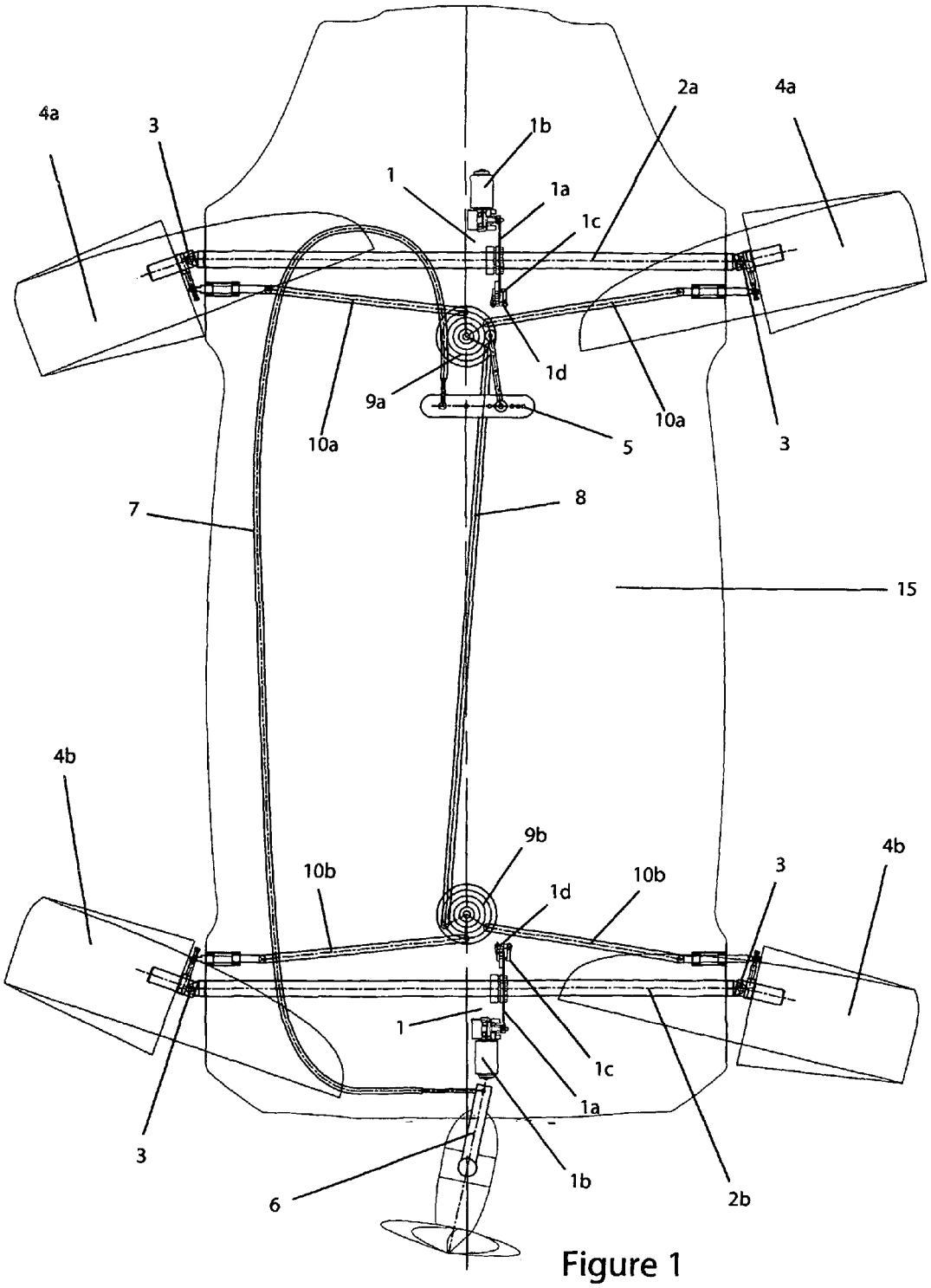

| | | | | | |
|---|---|---|---|---|---|
| 2,929,346 | A | * | 3/1960 | Perce | B63G 8/18 114/284 |
| 3,162,166 | A | * | 12/1964 | Handler | B63B 1/283 114/280 |
| 3,199,484 | A | | 8/1965 | Wiberg | |
| 3,949,695 | A | | 4/1976 | Pless | |
| 4,005,667 | A | * | 2/1977 | Staba | B63B 1/28 114/283 |
| 4,561,370 | A | * | 12/1985 | Sanford | B63B 1/04 114/125 |
| 4,582,011 | A | | 4/1986 | Logan | |
| 6,095,076 | A | | 8/2000 | Nesbitt | |

* cited by examiner

VESSEL CONTROL SYSTEM WITH MOVABLE UNDERWATER WINGS

The subject of the invention is a control system with movable underwater wings and an underwater wings lifting system with a safety brake. Specifically, it is a control system that supports the vessel's function with underwater wings and simultaneously controls the underwater wings lifting system and has a safety function in the form of the emergency brake.

The technical problem that the invention tackles, is steering a vessel with moving underwater wings and a motor (or wind propulsion) or only with moving wings. This reduces power consumption with minimal negative effects on the environment. The problem that the invention solves is how control a vessel with a flexible underwater wings—be it with the motor or the wings themselves—in order to minimize water resistance and, hence, energy consumption. While the system is using using an electric motor or wind propulsion it is one hundred percent environmentally friendly, while the use of an internal combustion engine has a significantly reduced the negative impact on the environment due to the fact that, only the ends of the wings are underwater, which makes the water resistance is minimal, energy consumption is significantly lower. This invention also reduces the noise emitted by a vessel, which is an additional positive impact on the environment. A further problem, which the invention addresses, is performing quick turns with a minimum radius and minimum vessel heeling. Therefore, the vessel turns in a nimble and agile manner and the voyage is safe, peaceful and smooth at both low as well as high speed, regardless of the waters' choppines.

The use of vessels with underwater wings is already known. The first vessel with such underwater wings was developed and designed by Italian inventor Enrico Forlanini in 1906. Similar solutions are used in many patents, such as for example in the patent U.S. Pat. No. 6,095,076, where the invention automatically adjusts the wings' camber when sailing, thus maintaining the vessel above the waterline, but it cannot use the wings to change direction. The invention patent U.S. Pat. No. 3,949,695 describes mechanical wing tilt control (manual) and only changes the angle in order to increase lift and cannot change the direction of travel. Invention patent U.S. Pat. No. 4,582,011 describes trimaran with foldable underwater wings, which can be folded back to allow for easy vessel transport. During the voyage, the wings do not move and remain fixed in set position. It is impossible to change direction using the wings. The invention in U.S. Pat. No. 3,199,484 automatically regulates the vessel's height depending on the speed. The system in patent SI 23103 A has retractable wings, which remain below sea level. The wings' lift is adjustable up to the water surface—the wing angle is adjustable between 0 and 60 degrees of the vertical position and is to be set before prior to sailing. The system uses the propulsion or the rudder to steer, which it cannot do with the wings. The invention is classified as a flying vessel seaplane or airplane. It is used in the so-called separate wings, which must be extended wide between themselves, so that may allow stable sailing. The invention patented SI 22250 is a regulated system for lifting vessels out of the water using a front mounted float.

A problem, which remains unresolved, is the mobility of wings during the voyage in order to provide steering. Related known solutions otherwise regulate wing angle, but this is to control the vessel's lift. This invention addresses with a special steering system, connected to obile underwater wings, which control both the lift and the steering of the vessel. A special lifting system with a safety brake allows stable, but adjustable adjustment of the wings in a pre-set position during the voyage. This same system also has a safety feature that returns the wings to their pre-set position in the event of a crash or hitting an obstacle.

The invention will be described the example and pictures showing:

FIG. 1: Floor plan of the steering system vessels with moving underwater wings and lifting system with safety brake FIG. 2: vessel with lowered moving underwater wings FIG. 3: a vessel with the raised moving underwater wings

Control System of the Vessel

The steering of the vessel is primarily conducted with with at least one wheel (steering wheel) 16, it is also possible to steer the vessel with a joystick, pedals (feet), with a control yoke and pedal (as in airplanes), an electronic control platform (touch screen or voice and the like) and other control solutions.

Previous similar technical solutions for control of similar vessels mainly only used the motor 6, which is also possible on this vessel through the aforementioned solutions. However, this method causes large vessel roll in the turning direction and increased energy consumption.

The invention therefore makes steering possible (via the above-mentioned modes) with at least two pairs of wings 4*a* and 4*b*. When turning, the front pair of wings 4*a* turns into the direction of turn, and the rear pair of wings 4*b*, in the opposite direction, thereby reducing turning radius. The pairs of wings 4*a* and 4*b* settle in the direction of the turn radius. The front water resistance for the underwater wings is significantly reduced, because underwater wings travel exactly in the direction of travel and not create drag with their flanks. Thus the turning is quick, the vessel roll is minimal. The steering system with moving underwater wings works with at least two pairs of underwater wings 4*a* and 4*b*, or with at least two underwater wings, one located at the front of vessel, and the other at the back. In case of larger vessels it is possible to add additional wings, depending on the length and size of the vessel. In case of a large number of wings the wing movement and turning system remains the same. The minimal roll of the vessel while turning gives a uniform maximum distance between the waterline and the entire vessel hull, which is an advantage in wavy water, since waves do not crash into the hull, which enables a lower energy consumption, and a peaceful and quiet ride. The wings 4*a* and 4*b* are used to steer through the control system which is comprised of:

The linking axles 8

Two lever disks: the front disk 9*a* and rear disk 9*b*

The front 10*a* and rear levers 10*b*

The lever plate 5

The wing steering system leaves can be operated in the above-mentioned ways by turning the wheel 16 (or other control elements above vessel), which is connected to the lever plate 5, in the desired direction of travel. The lever plate 5 with the angle in turn direction and rotates lever discs 9*a* and 9*b*, which are linked to the linking axle 8, which, during the turn and rotation of lever discs 9*a* and 9*b* is moved along the vessel (forwards or backwards, depending on the turning direction; if we turn to the left, the linking axle 8 moves toward the stern 12, however, if we turn to the right, the linking axle 8 moves toward the bow of the vessel 11. In this, the front lever disc 9*a* turns in the direction of the turn and the rear lever disc 9*b* turns in the opposite direction.

The lever discs 9*a* and 9*b* are mounted on each side levers 10*a* and 10*b* which, when turning the lever discs 9*a* and 9*b* are moved in the appropriate direction, namely, both the front levers 10*a* as well as rear levers 10*b* move the direction of the turn, wings 4*a* and 4*b*, which are connected to the levers 10*a* and 10*b*, however, due to the way the levers connect to wings 4*a* and 4*b* turn opposite directions. Thus, the front wings 4*a* turn in the direction of the turn and the rear wings 4*b*, turn in the opposite direction. When turning, the underwater wings 4*a* and 4*b*, produce less drag, because they follow the direction of the turn and because the sides of the wings do not push on water (like classic rudders) but follow the direction of travel. It is also possible to steer with only the front wings 4*a* or only rear wings 4*b* or with both the front and rear wings at 4*a* and 4*b*, as described above. Moreover, it is possible to steer with only the wings on the right or on the left side of the vessel.

The main advantage of the invention is the combined steering (via the above-mentioned steering modes) with wings 4*a* and 4*b* and the motor 6 at the same time. With this kind of combined steering, the vessel does not roll at a certain proportion between the angle of the underwater wings and angle of the motor. The wings 4*a* and 4*b* are therefore under equal loads and the hull is at its highest position above the water. This achieves the minimum possible wettability of the underwater wings and the maximum speed of the vessel. This is especially important with wavy waters, where it is desired to keep the hull above the waterline or at the highest possible position above the water. In the combined steering mode (using the wings 4*a* and 4*b*, as well as the motor 6) energy consumption is reduced, the vessel does not produce waves, making the voyage steadier and safer. All of the above can be done even at low speeds in the combined steering mode (wings 4*a* and 4*b* and the motor 6). In combined steering mode, the Bowden cable 7, which is mounted on lever plate 5 and connects it with motor 6 steering, moves the motor 6 in the same direction as the rear wings 4*b*, or, in the opposite direction as the front wings 4*a*.

A lower fuel consumption can be achieved with raising the hull early and sailing on the wings. This can be achieved at a low speeds if we change the angle of the motor 6 with the Bowden cable 7 that steers the motor, with which we can move the motor 6 away from the vessel's stern 12. The adjustable angle between the motor 6 and the stern of the vessel 12 can thus be reduced during sailing and can, therefore, increase the vessel's top speed.

The steering system of the vessel is primarily rigid with a direct transfer made with levers. It is, however, possible to make a hydraulic steering system or a system with ropes or other mechanisms and elements that enable movement.

The Drive or Vessel Motor 6

The motor 6 is preferably an electric outboard motor with a submersible propeller, but may also be an internal combustion engine, hybrid or jet. However, they can also be used with an outboard motor with a partially submerged propeller, which may be electric, internal combustion or hybrid and an aircraft engine with the propeller above the waterline. Wind propulsion is also possible. The pushdrives (electric motors or internal combustion engines) are usually located at the stern of the vessel (the rear of the vessel) 12, it is also possible for the motors to be located at the ends of the underwater part of the wings, and can be electric, internal combustion, hybrid or jet. It is also possible to place the drive on the front end of the vessel 11, such as various pull motors and wind propulsion.

The Lift System 1 with the Safety Brake 1c

The lift system 1 with the safety brake 1*c* is primarily mechanical, but can also be hydraulic, electric, with levers or other mechanisms or elements that enable movement. It is installed on the front 2*a* and the rear axle 2*b*. The number of lifting systems 1 with a safety brake 1*c* depends on the number of axles, which have wings attached to them. It is composed of:

- the disc or sprocket 1*a* that allows rotation of the axles 2*a* and 2*b* and the joints 3, the wings 4*a* and 4*b* are attached to
- the electric motor 1*b* that drives the disc 1*a*
- the brake 1*c* that keeps the wings in their set position.
- the sensor 1*d* that detects the change of angle of the wings 4*a* and 4*b* and returns them to the preset position/angle.

Figure 2:
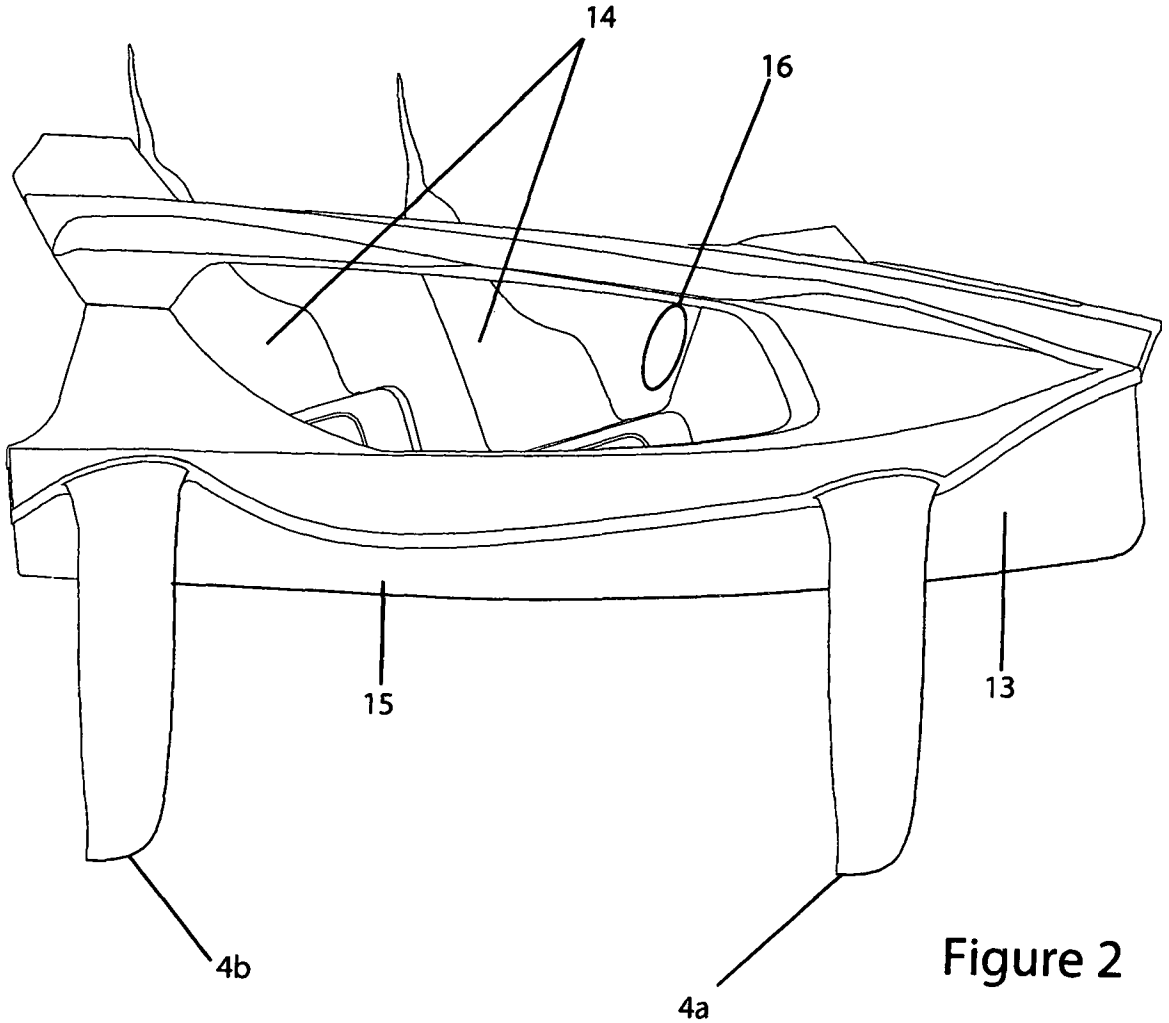

The lifting system 1 with the safety brake 1*c* allows the lowering of wings 4*a* and 4*b* under the hull of the vessel to the desired position and attitude, as shown in FIG. 2, which results in a buoyancy and thus the vessel already rising from the water, at very low speed. With the help of the electric motor the disc or sprocket 1*a* rotates the front 2*a* and rear axle 2*b*, the joints 3 and wings 4*a* and 4*b*, which are attached thereto into the position set through the control unit prior to sailing. The brake 1*c* holds the entire lifting system 1 in the set position with the wings 4*a* and 4*b*.

Figure 3:
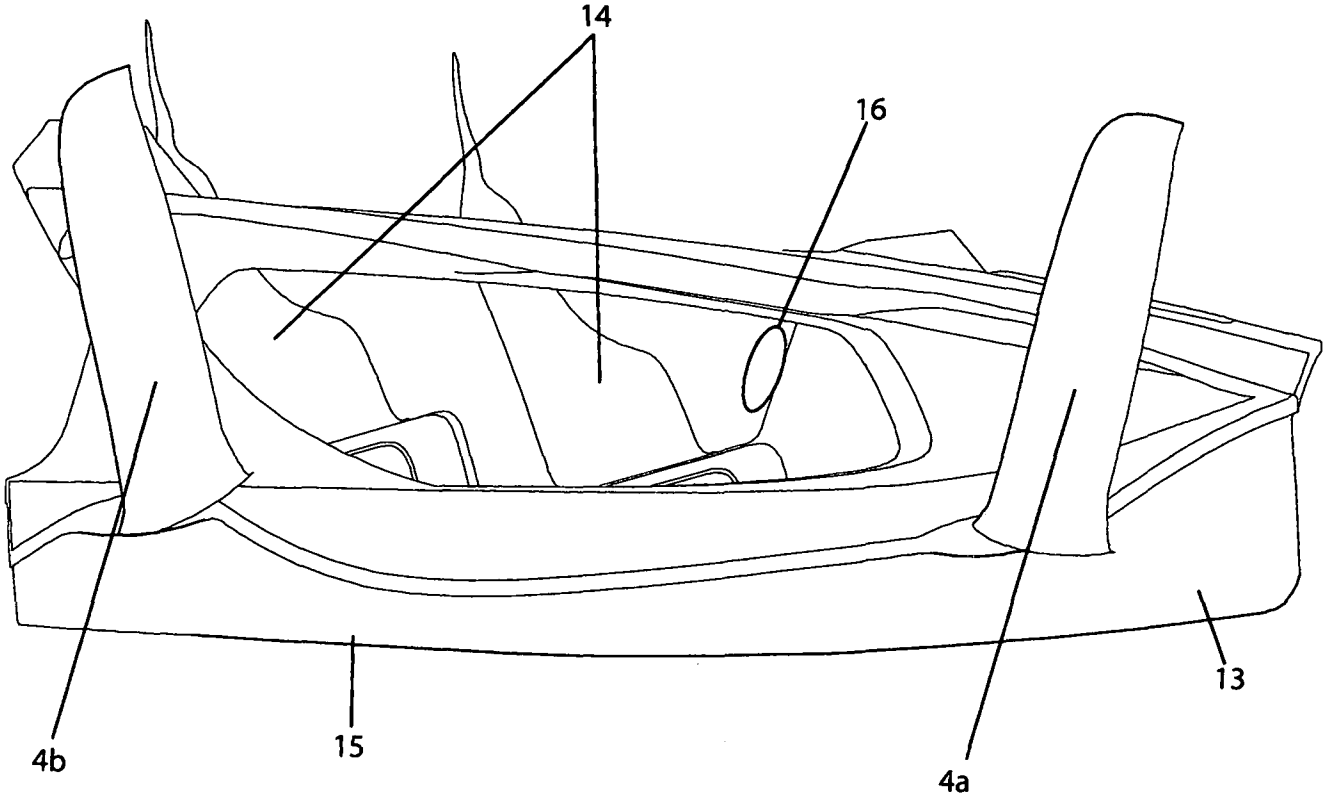

The lifting system 1 with the safety brake 1*c* also enables the wings to rise above the vessel as shown in FIG. 3. During this, the disc 1*a* rotates the axles 2 and joints 3 into a position that enables the wings 4*a* and 4*b* to be lifted above the vessel. This is useful when the vessel is in shallow water, during transportation (the wings 4*a* and 4*b* can also be removed with a simple procedure), and also in berth, when the vessel is in the water for a long time. This way the accumulation of algae, sludge and similar is prevented. Moreover this prevents (salt) water erosion and extends the wings' 4*a* and 4*b* lifetime. In case of high waves, when sailing with wings 4*a* and 4*b* is difficult the wings 4*a* and 4*b* are raised above the vessel as shown in FIG. 3, to enable the vessel to continue sailing. Sailing can continue as a vessel without wings (eg. boat) to ensure additional safety for passengers and vessels.

The lifting system with the safety brake 1*c* also has a safety function, which in the case of hitting an obstacle, makes the system reduce the force of impact on the wings 4*a* and 4*b*, in that the brake 1*c*, which normally holds the wings in a set position, works as a classic brake. Upon hitting the obstacle the wings 4*a* and 4*b* rotate in order to brake, which decreases the chance of damage of the vessel and its passengers. The system has a built-in sensor that returns the wings 4*a* and 4*b* in the desired position or angle upon stabilization after the crash.

The preference mode for the wing 4*a* and 4*b* position settings is pre-set, and can be set as such before staring sailing. One can, however, adjust (optimize) the wings 4*a* and 4*b* during sailing through the system the system, which measures the water resistance at the specified speed, taking into account the data on the weight of the passengers and cargo, which has previously been recorded in the control platform in the cabin.

The invention claimed is:

1. A steering control system comprising at least two pairs of underwater wings being able to arranged to steer a vessel having a hull, seats and helm a wheel, a lever plate installed in a lower part of the vessel's interior and having mounted a Bowden cable connecting said lever plate with a motor, a front disc, a linking axle linking said front disc and a rear disc and allowing said front and rear discs to turn in opposite direction, a front lever and a rear lever mounted on one side of said front disc and rear disc respectively and connecting said front and rear discs to the wings and wherein a safety brake is mounted on a lifting system of the moving underwater wings.

2. The steering control system of the vessel according to claim 1, wherein when steering without the motor, the lever plate is connected with the front disc via a lever, wherein the front disc is connected to the rear disc by the linking axle and the discs are connected via the levers with the wings, which are attached to a front axle and a rear axle.

3. The steering control system of the vessel according to claim 1, wherein the front levers of the control system are connected to the front wings behind joints with which the front wings are attached to a front axle, and the rear levers of the control system are connected to the rear wings in front of joints with which the wings are attached to a rear axle.

4. The steering control system of the vessel according to claim 1, wherein at least the lever plate, which is connected to the motor with the Bowden cable and is connected to the front disc via a lever, wherein the front disc is connected to the rear disc with the linking axle and the discs are connected to the wings via the levers, which are attached to the axles onto which, the lifting system of moving underwater wings with the safety brake is mounted.

5. The steering control system of the vessel according to claim 1, wherein in the combined steering mode with the motor and wings and, the Bowden cable is mounted on the lever plate and connected to the motor.

6. The steering control system of the vessel according to claim 1, wherein on the front and rear axles and, onto which the wings are attached, a disc or a sprocket is installed, to which an electric motor is attached, and the safety brake with a sensor is added.

7. A process of controlling the steering control system according to claim 1, that wherein when steering is performed without the motor the wheel, which is connected to a lever plate, is turned in a direction of travel, the lever plate rotates in the direction of the turn and spins the discs, which are cross-linked with a linking axle, to which the underwater wings of the lifting system with the safety brake is connected, which axle at the turn of the disc moves along the length of the vessel, while the front disc turns in the direction of the turn while the rear disc turns in the opposite direction of the turn and so moves the levers in the direction of a turn, while the wings, which are connected to the levers, turn in the opposite direction and so the front wings turn in the direction of the turn while the rear wings turn in the opposite direction of a turn.

8. The process of controlling the steering control system of the vessel according to claim 7, wherein with the combined steering with the motor and the wings, the Bowden cable, which is attached to the lever plate and connects the lever plate to the motor, moves the motor in the same direction as the rear wings at the turn of the wheel.

9. The process of controlling the steering control system of the vessel according to claim 8, wherein the lifting system with the safety brake reduces impact force on the wings, so that the brake, which holds the wings in a pre-set position, is released and the wings a rotate backward.

10. The process of controlling the steering control system of the vessel according to claim 7, wherein the lifting system with the safety brake with the help of an electric motor rotates a front axle, a rear axle and joints in a position that allows the wings to lower under the hull of the vessel into the water.

11. The process of controlling the steering control system of the vessel according to claim 7, wherein with the help of an electric motor the lifting system with the safety brake rotates a front axle and a rear axle and joints, which are attached to the axles, into the position that were set upon the control unit prior to sailing, and the brake holds the wings in a pre-set position.

12. The process of controlling the steering control system of the vessel according to claim 7, wherein the lifting system with the safety brake with the help of an electric motor rotates the front axle, the rear axle and joints into a position that allows the wings to rise out of the water.

* * * * *